US006913372B2

(12) United States Patent
Allcock et al.

(10) Patent No.: US 6,913,372 B2
(45) Date of Patent: Jul. 5, 2005

(54) LAMP ASSEMBLY

(75) Inventors: Michael Allcock, Worcestershire (GB); Stuart Wilson, Worcestershire (GB)

(73) Assignee: F.W. Thorpe Plc, Worcestershire (GB)

( * ) Notice: Subject to any disclaimer, the term of this patent is extended or adjusted under 35 U.S.C. 154(b) by 184 days.

(21) Appl. No.: 10/221,939

(22) PCT Filed: Mar. 19, 2001

(86) PCT No.: PCT/GB01/01163

§ 371 (c)(1),
(2), (4) Date: Oct. 23, 2002

(87) PCT Pub. No.: WO01/71245

PCT Pub. Date: Sep. 27, 2001

(65) Prior Publication Data

US 2004/0012968 A1 Jan. 22, 2004

(30) Foreign Application Priority Data

Mar. 18, 2000 (GB) ..... 0006476

(51) Int. Cl.[7] ..... F21V 5/00

(52) U.S. Cl. ..... 362/223; 362/225; 362/245; 362/336

(58) Field of Search ..... 362/223, 225, 362/240, 244, 245, 308, 311, 336, 337, 338, 340

(56) References Cited

U.S. PATENT DOCUMENTS

| | | | | |
|---|---|---|---|---|
| 2,050,429 A | | 8/1936 | Dorey et al. | |
| 2,255,433 A | * | 9/1941 | Moss | 362/240 |
| 2,556,690 A | * | 6/1951 | Guth | 362/225 |
| 2,748,263 A | | 5/1956 | Franck et al. | |
| 3,275,822 A | * | 9/1966 | Wince et al. | 362/223 |
| 4,338,653 A | * | 7/1982 | Marrero | 362/223 |

FOREIGN PATENT DOCUMENTS

GB 715 279 A 9/1954

* cited by examiner

*Primary Examiner*—Y. My Quach-Lee
(74) *Attorney, Agent, or Firm*—Nixon & Vanderhye P.C.

(57) ABSTRACT

The assembly has two lamps, such as fluorescent tubes. A cover is a co-extrusion having a baffle between the lamps and shroud portions outermost of the cover. The baffle blocks at least some of the light output of the lamps from crossing the region between the lamps. This helps reduce glare, which is further reduced by the configuration of the shrouds.

16 Claims, 1 Drawing Sheet

LAMP ASSEMBLY

This application is the US national phase of international application PCT/GB01/01163 filed 19 Mar. 2001, which designated the US.

BACKGROUND AND SUMMARY OF THE INVENTION

The present invention relates to multi-lamp assemblies and in particular, but not exclusively, to lamp assemblies for use with linear lamps, such as fluorescent tubes and the like.

The present invention provides a lamp assembly which comprises mountings to hold, in use, a plurality of lamps, there being at least two lamp positions which are spaced apart to define a region between the positions, the assembly further comprising a window corresponding with each lamp position and through which light leaves the assembly during use, and a baffle member positioned in the region to allow each lamp to illuminate directly a respective window and to block, in use, at least some of the light output of lamps at these positions from crossing the region to leave through a window corresponding with another lamp.

Preferably the baffle member is positioned to block at least some of the light leaving the lamp positions at an angle below a minimum angle from a vertical line extending down from the lamp position. The baffle member may be positioned to block at least some of the light leaving each lamp position from reacting the other lamp position. The baffle member may be clear, translucent, opaque or semi-opaque and is preferably formed to deflect incident light, such as by means of prisms. The baffle member surface may be formed as a series of refracting prisms. The lamp assembly may comprise mountings formed to support parallel linear lamps, the baffle member being elongate and positioned to extend parallel with the lamps along the region between the lamp positions.

The lamp assembly may further comprise at least one shroud member spaced from one lamp position in the direction generally opposite the direction of the other lamp position, the shroud member serving to block at least some of the light leaving said one lamp position above a maximum angle from a vertical line extending down from the lamp position. Preferably each lamp position is provided with a shroud member. The or each shroud member may be clear, translucent, opaque or semi-opaque. The surface of the or each shroud member is preferably formed to deflect incident light, such as by means of prisms. The surface of the or each shroud member is preferably formed as a series of refracting prisms. The lamp assembly may comprise mountings formed to support parallel linear lamps, the or each shroud member being elongate and positioned to extend parallel with the lamp positions.

The baffle member and the or each shroud member are preferably linked to form a cover member within which the lamp positions are located. There may be a web section extending from the baffle member to link the baffle member with the or each shroud member. The web section preferably provides the said windows. The baffle member, web section and the or each shroud member may be formed as a co-extrusion.

The invention also provides a cover for a lamp assembly according to any of the preceding definitions, the cover comprising a baffle member as aforesaid.

BRIEF DESCRIPTION OF THE DRAWINGS

An embodiment of the present invention will now be described in more detail, by way of example only, and with reference to the accompanying drawings, in which:

FIG. 1 shows a lamp assembly 10 which may, for instance, be suspended from a ceiling in a building.

DETAILED DESCRIPTION OF PREFERRED EMBODIMENTS

Figure 1:
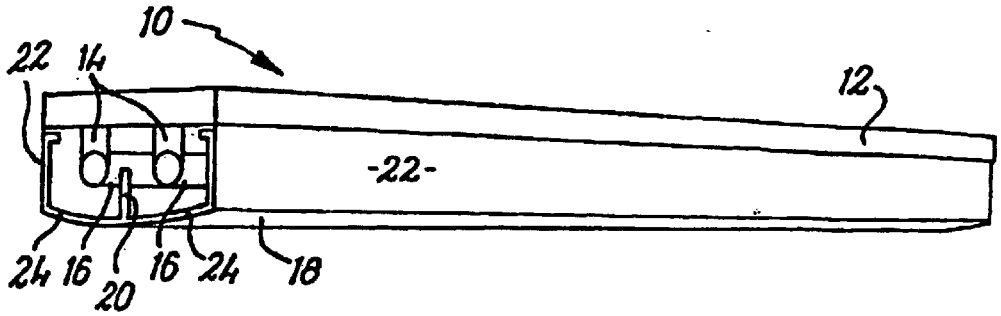
FIG. 1 is a schematic perspective view of a lamp assembly according to the present invention.

The assembly 10 has a base 12 for attachment to the ceiling, and which provides mountings 14 for holding two lamps 16A, 16B. The lamps 16 are linear lamps, such as fluorescent tubes, T5 r T16 lamps. FIG. 1 shows mountings 14 at one end of the lamps, there being equivalent mountings (not shown) at the other end of the base 10, for supporting the other end of the lamps 16. The mountings 14 also provide electrical connections to the lamps 16. Conventional control gear for star and driving the lamps 16 is housed within the base 12.

Figure 2:
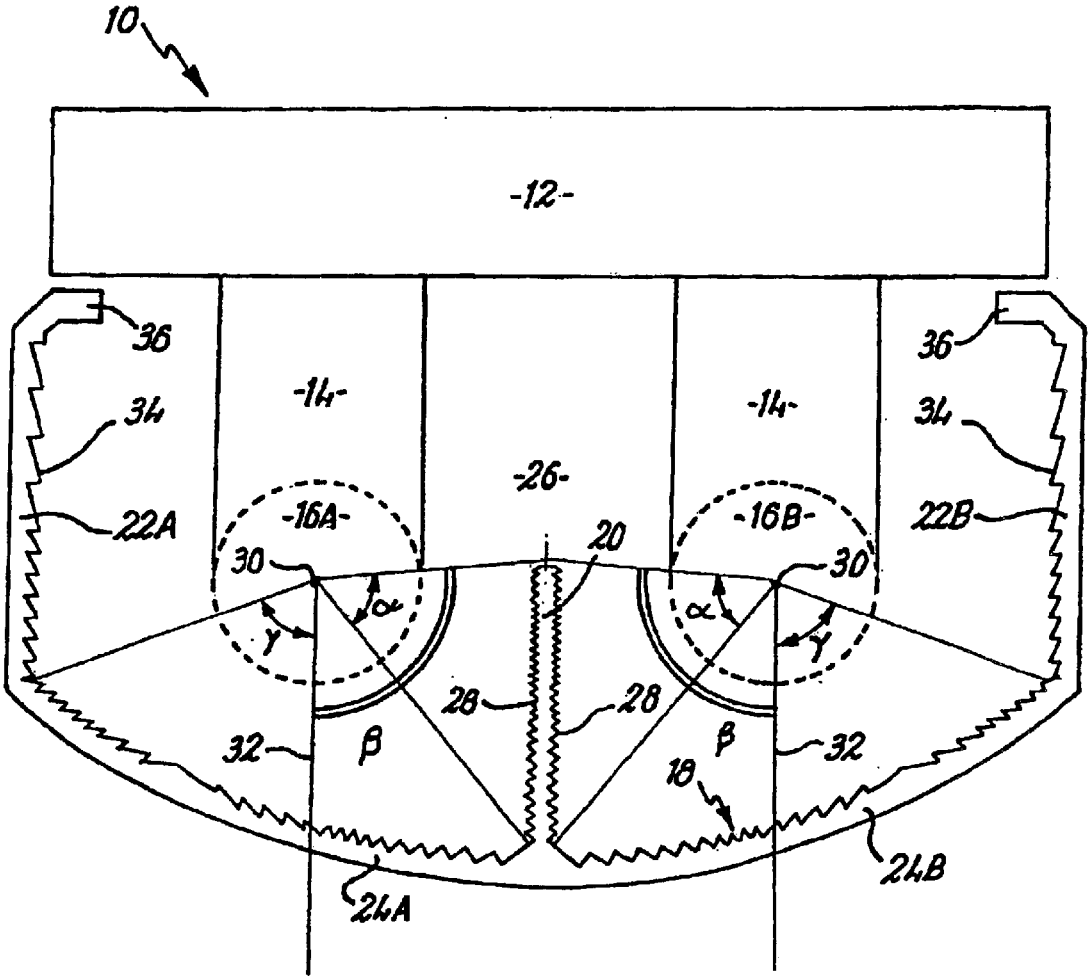
FIG. 2 is a vertical, axial section of the lamp assembly of FIG. 1, on an enlarged scale.

The lamp assembly 10 also includes a cover 18, the details of which are most clearly shown in FIG. 2. It should be noted that the terms "base" and "cover" are used in a manner which is conventional within the art, notwithstanding that after installation of the assembly 10, the base 12 will generally be uppermost (immediately below the ceiling), and the cover 18 will be lowermost, hanging from the base 12.

The cover 18 is a co-extrusion of constant cross-section along the length of the assembly 10. The cover 18 has several different portions, as follows. A baffle portion 20 is located centrally, between the lamps 16. Shroud portions 22 are located outermost and are connected with the baffle portion 20 by web portions 24. The portions 20, 22, 24 are all continuous along the whole length of the cover 18.

The baffle portion 20, when in use, extends generally vertically up from the web portion 24, within the region 26 between the lamps 16. The vertical faces 28 of the baffle portion 20 are faceted to form refracting prisms in a manner conventional in itself, so as to deflect incident light down toward the web portion 24. Diffusion, refraction or reflection may be used for deflection. The body of the baffle portion 20 may be opaque or semi-opaque, so that any light not deflected will be wholly or partially absorbed within the baffle portion 20. The body of the baffle portion may be clear or translucent, the deflection being achieved by the prisms.

The upper and lower extremities of the vertical faces 28 subtend an angle $\alpha$ at the axis 30 of the lamps 16 so that any light leaving the lamps 16 within this range of angles will impinge on the baffle portion 20 and be blocked or partially blocked from travelling further across the region 26. In particular, the light blocked in this manner and originating from the lamp 16A will be prevented from crossing the region 26 to leave the lamp assembly 10 past the lamp 16B. Similarly, at least some of the output of the lamp 16B will be blocked from leaving the lamp assembly 10 past the lamp 16A. It can also be seen from FIG. 2 that the baffle portion 20 extends above the height of the lamps axes 30. The baffle portion 20 therefore serves to block at least some of the light from either of the lamps 16 reaching the other lamp. Interlamp reflections of this nature will cause a reduction in the overall output of the assembly 10, and thus of its efficiency, and this drawback is found to be reduced by the presence of the baffle portion 20.

The upper extremity of the faces 28 also serve to define a minimum angle, relative to a vertical line 32 extending down from the axis 30 of each lamp 16, this angle being designated β in FIG. 2 (shown via a double arc between the vertical line 32 and the line from the axis 30 to the upper extremity of the corresponding face 28). Light leaving the lamps 16 will only pass above the baffle portion 20, and thus be unaffected by its presence, if the angle from the line 32 is greater than β. This is significant in reducing glare, as will be described.

The shroud portions 22 are each spaced from one of the lamps 16 in the direction generally opposite the direction of the other lamp 16. Thus, the lamp 16A is between the shroud 22A and the lamp 16B, while the lamp 16B is between the shroud 22B and the lamp 16A. Thus, while the baffle portion 20 is within the region 26, the shrouds 22 are located outside the region 26, to the other sides of the lamps 16.

Each shroud portion 22 is a generally vertical wall which has a vertical face 34 facing the nearest lamp 16 and which is formed as a series of refracting prisms, to deflect incident light down toward the web portion 24, generally in the manner which has been previously described in relation to the vertical faces 28 of the baffle portion 20.

A peripheral flange 36 is provided at the upper edge of each face 34, for use in attaching the cover 18 to the base 12.

The bodies of the shroud portions 22 may be opaque or semi-opaque, such as an opal, opalised or satin material to have a softening, diffusing or blocking effect on any light which passes into the shroud 22 without being deflected by the surface prisms. The action of the prisms may deflect light sufficiently for the shroud portions to be of clear or translucent material.

No light can leave the assembly 10 above the shrouds 22, by virtue of the presence of the base 12. In order to leave the assembly 10 below the shrouds 22, light must leave a lamp 16 with an angle from the vertical line 32 no greater than a maximum angle indicated as γ in FIG. 2.

The web portions 24 extend inwardly from the shrouds 22, to the baffle portion 20 and may be clear or diffusing material as required by the intended application of the lighting. The web portions 24 provide windows for light leaving the assembly 10, defined on either side of the baffle portion 20, each window being between the baffle portion 20 and one of the shroud portions 22. The relative positions of the baffle portion 20 and the shrouds 22 ensures that the light leaving through either of these windows will have been controlled, as follows.

Light leaving through the left-hand web portion 24A (as seen in FIG. 2) will have reached the web portion 24A direct from the lamp 16A if originally leaving the lamp below the maximum angle γ defined by the shroud portion 22A, or below the angle (β-α) defined by the lower edge of the baffle portion 20. Appropriate positioning of these features can set these angles to ensure that this direct light will not cause unacceptable glare. In particular, it is common to seek to provide direct lighting of this nature from tubular lamps at an angle of no greater than about 65° from the vertical. At angles greater than this, the light can cause glare by entering the peripheral or direct vision of a person in the room being illuminated. Below this angle, the light will reach a user from a position more directly above the user's head and thus generally outside direct or peripheral vision. Other light will leave the web portion 24A having been reflected from the baffle portion 20 or shroud portion 22A, thus softening this light and preventing it from contributing unacceptably to glare.

Furthermore, it can be seen that the window provided by the web portion 24A does not allow the lamp 16B to be viewed directly through the web portion 24A. This arises from the relative heights of the top of the baffle portion 20 and the bottom of the shroud portion 22A, in relation to the heights and spacings of the lamps 16A. Thus, when the lamp assembly 10 is sufficiently far away from a user for a ceiling-mounted lamp to be visible in the peripheral vision of a reader, for instance, lamp image brightness and consequential glare will be reduced from that which would occur without the baffle portion 20 being present. Furthermore, the prism deflectors on the vertical faces 28, 34 will deflect more of the light output downwardly (to small angles from the vertical lines 32).

A further effect arises from the presence of the baffle portion 20, which may be beneficial in some circumstances. The presence of the baffle portion 20 is found to provide some thermal containment around each lamp 16, which is greater than would be provided in the absence of the baffle portion 20, by virtue of the physical barrier provided by the baffle portion 20. It has been found that this has the effect of causing the lamps 16 to run at higher temperatures than would be the case without the presence of the baffle 20. In particular, this effect can be beneficial with T5 lamps, which run most efficiently at temperatures above the ambient temperature found in many working environments. The baffle portions 20 contribute to an increased lamp operating temperature, which therefore further increases the efficiency of the assembly 10 and the effectiveness of the lighting provided by it.

The cover 18 has been described as a co-extrusion. Techniques of co-extrusion are well known to the skilled reader. Co-extrusion allows the material of the various portions 20, 22, 24 to be selected individually, according to the function those portions are intended to serve. Thus, in one example, the baffle portion 20 and the web parts 24A,24B may be clear material, with the baffle effects of the baffle portion 20 being provided mainly by virtue of the prism surface provided on the faces 28, the prisms serving to refract light downwards, outside peripheral vision. However, the shroud portions 22A,22B in this example are of a diffusing material such as a satin, opal or opalised material so that any light leaving the assembly 10 through the shrouds 22 will be soft and diffused. However, the prism faces 34 will tend to deflect incident light down to the web portions 24, by refraction, so that the shroud portions may be of clear or translucent material. The overall effect is to tend to direct the light output down through the web portions 24, and away from leaving through the shroud portions 22, so that in comparison with the situation with the cover 18 removed, more of the light output is directed in a generally downward direction at angles which will provide good lighting without glare, and less light is allowed to leave at angles which could contribute to glare.

Many variations and modifications can be made from the apparatus described above, without departing from the scope of the invention. In particular, the particular shapes, dimensions and relative dimensions of the features can be varied, according to the properties and angles required of the light output. Various different materials may be used for the various regions of the cover, according to their light reflecting and transmitting characteristics. Although the cover 18 has been described as a single article formed by co-extrusion of different materials, it is envisaged that the cover 18 could be formed by extrusion from a single material, or could be formed by assembling various components, each formed separately.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A lamp assembly which comprises mountings to hold, in use, a plurality of lamps, there being at least two lamp positions which are spaced apart to define a region between the positions, the assembly further comprising a window corresponding with each lamp position and through which light leaves the assembly during use, and a baffle member positioned in the region to allow each lamp to illuminate directly a respective window and to block, in use, at least some of the light output of the lamps at these positions from crossing the region to leave through a window corresponding with another lamp, wherein each lamp position is provided with a shroud member formed to deflect incident light by means of prisms, each shroud member being spaced from a respective lamp position in a direction generally opposite the direction of the other lamp position, the shroud member serving to, block at least some of the light leaving said respective lamp position above a maximum angle, which is a window portion exit angle, from a vertical line extending down from said respective lamp position.

2. A lamp assembly according to claim 1, wherein the baffle member is positioned to block at least some of the light leaving the lamp positions at an angle below a minimum angle, which is a baffle angle, from a vertical line extending down from the lamp position.

3. A lamp assembly according to claim 1, wherein the baffle member is positioned to block at least some of the light leaving each lamp position from reaching the other lamp position.

4. A lamp assembly according to claim 1, wherein the baffle member is clear, translucent, opaque or semi-opaque.

5. A lamp assembly according to claim 1, wherein the baffle member is formed to deflect incident light.

6. A lamp assembly according to claim 5, wherein the baffle member is formed to deflect light by means of prisms.

7. A lamp assembly according to claim 6, wherein the baffle member surface is formed as a series of refracting prisms.

8. A lamp assembly according to claim 1, and comprising mountings formed to support parallel linear lamps, the baffle member being elongate and positioned to extend parallel with the lamps along the region between the lamp positions.

9. A lamp assembly according to claim 1, wherein the or each shroud member is clear, translucent, opaque or semi-opaque.

10. A lamp assembly according to claim 1, wherein the surface of the or each shroud member is formed as a series of refracting prisms.

11. A lamp assembly according to claim 1, comprising mountings formed to support parallel linear lamps, the or each shroud member being elongate and positioned to extend parallel with the lamp positions.

12. A lamp assembly according to claim 1, wherein the baffle member and the or each shroud member are linked to form a cover member within which the lamp positions are located.

13. A lamp assembly according to claim 1, wherein a web section extending from the baffle member links the baffle member with the or each shroud member.

14. A lamp assembly according to claim 13, wherein the web section provides the said windows.

15. A lamp assembly according to claim 13, wherein the baffle member, web section and the or each shroud member are formed as a co-extrusion.

16. A cover for a lamp assembly according to claim 1, the cover comprising the baffle member.

* * * * *